US007530661B2

(12) United States Patent
Hess

(10) Patent No.: US 7,530,661 B2
(45) Date of Patent: May 12, 2009

(54) SUBSTRATE AND METHOD OF FORMING SUBSTRATE FOR FLUID EJECTION DEVICE

(75) Inventor: Jeffery S. Hess, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 323 days.

(21) Appl. No.: 11/492,141

(22) Filed: Jul. 24, 2006

(65) Prior Publication Data

US 2007/0023389 A1 Feb. 1, 2007

Related U.S. Application Data

(62) Division of application No. 10/062,050, filed on Jan. 31, 2002, now Pat. No. 7,105,097.

(51) Int. Cl.
*B41J 2/015* (2006.01)

(52) U.S. Cl. ..... 347/20

(58) Field of Classification Search ..... 347/20, 347/54, 56

See application file for complete search history.

(56) References Cited

U.S. PATENT DOCUMENTS

| | | | | |
|---|---|---|---|---|
| 4,601,777 | A | 7/1986 | Hawkins et al. | |
| 4,808,260 | A | 2/1989 | Sickafus et al. | |
| 4,985,710 | A * | 1/1991 | Drake et al. | 347/63 |
| 5,317,346 | A | 5/1994 | Garcia | |
| 5,608,436 | A | 3/1997 | Baughman et al. | |
| 5,871,656 | A | 2/1999 | Silverbrook | |
| 5,971,527 | A | 10/1999 | Peeters et al. | |
| 6,107,209 | A | 8/2000 | Ohkuma | |
| 6,132,034 | A | 10/2000 | Miller | |
| 2001/0024222 | A1 | 9/2001 | Ohno et al. | |
| 2002/0118253 | A1 | 8/2002 | Ohno et al. | |

FOREIGN PATENT DOCUMENTS

| | | |
|---|---|---|
| EP | 0430593 | 6/1991 |
| EP | 0841167 | 5/1998 |
| EP | 1038676 | 9/2000 |
| EP | 1138491 | 10/2001 |
| EP | 1138491 A2 | 10/2001 |
| JP | 4-312853 A | 11/1992 |
| JP | 2000255069 | 3/1999 |

OTHER PUBLICATIONS

UK Search Report for United Kingdom Patent Application No. 0301946.0 mailed Mar. 13, 2003.

* cited by examiner

*Primary Examiner*—An H Do

(57) ABSTRACT

A substrate for a fluid ejection device includes a first side, a second side opposite the first side, and a fluidic channel communicating with the first side and the second side. A first portion of the fluidic channel extends from the first side toward the second side, a second portion of the fluidic channel extends from the second side toward the first side, and a third portion of the fluidic channel extends from an interface between the first portion and the second portion of the fluidic channel toward the second side.

32 Claims, 17 Drawing Sheets

SUBSTRATE AND METHOD OF FORMING SUBSTRATE FOR FLUID EJECTION DEVICE

CROSS-REFERENCE TO RELATED APPLICATIONS

This application is a Divisional of U.S. patent application Ser. No. 10/062,050, filed on Jan. 31, 2002, now U.S. Pat. No. 7,105,097 which is incorporated herein by reference.

THE FIELD OF THE INVENTION

The present invention relates generally to fluid ejection devices, and more particularly to a substrate for a fluid ejection device.

BACKGROUND OF THE INVENTION

In some fluid ejection devices, such as printheads, a drop ejecting element is formed on a substrate and fluid is routed to an ejection chamber of the drop ejecting element through an opening or slot in the substrate. Often, the substrate is a silicon wafer and the slot is formed in the wafer by chemical etching. Existing chemical etching processes, however, result in etch angles that cause a very wide backside opening of the slot in the substrate. The backside of the substrate is defined as a side of the substrate opposite of which the drop ejecting element is formed.

Unfortunately, the wide backside slot opening limits how close to each other slots can be formed in a particular die. In addition, the wide backside slot opening reduces useful area of the backside of the substrate. For example, the wide backside slot opening reduces adhesion area of the backside of the substrate.

Accordingly, it is desired to minimize a size of the opening in the backside of the substrate.

SUMMARY OF THE INVENTION

One aspect of the present invention provides a substrate for a fluid ejection device. The substrate includes a first side, a second side opposite the first side, and a fluidic channel communicating with the first side and the second side. A first portion of the fluidic channel extends from the first side toward the second side, a second portion of the fluidic channel extends from the second side toward the first side, and a third portion of the fluidic channel extends from an interface between the first portion and the second portion of the fluidic channel toward the second side.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
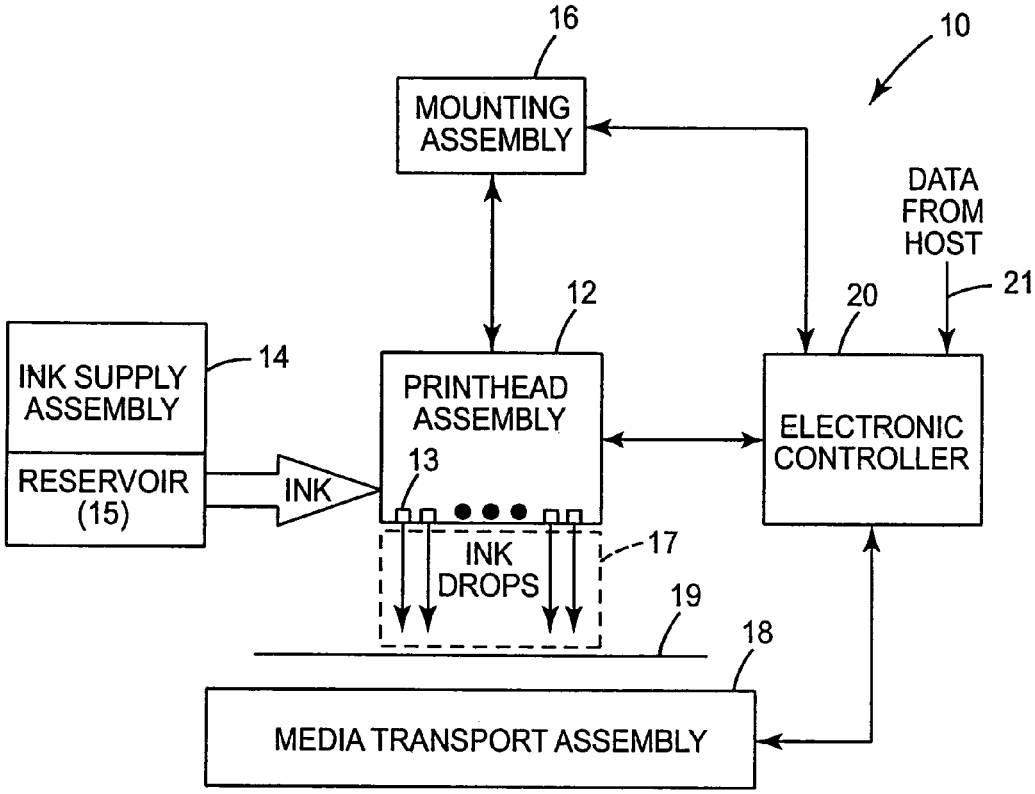
FIG. 1 is a block diagram illustrating one embodiment of an inkjet printing system according to the present invention.

FIG. 1 illustrates one embodiment of an inkjet printing system 10 according to the present invention. Inkjet printing system 10 includes an inkjet printhead assembly 12, an ink supply assembly 14, a mounting assembly 16, a media transport assembly 18, and an electronic controller 20. Inkjet printhead assembly 12 is formed according to an embodiment of the present invention, and includes one or more printheads or fluid ejection devices which eject drops of ink through a plurality of orifices or nozzles 13 and toward a print medium 19 so as to print onto print medium 19. Print medium 19 is any type of suitable sheet material, such as paper, card stock, transparencies, Mylar, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to printhead assembly 12 and includes a reservoir 15 for storing ink. As such, ink flows from reservoir 15 to inkjet printhead assembly 12. Ink supply assembly 14 and inkjet printhead assembly 12 can form either a one-way ink delivery system or a recirculating ink delivery system. In a one-way ink delivery system, substantially all of the ink supplied to inkjet printhead assembly 12 is consumed during printing. In a recirculating ink delivery system, however, only a portion of the ink supplied to printhead assembly 12 is consumed during printing. As such, a portion of the ink not consumed during printing is returned to ink supply assembly 14.

In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled. In one embodiment, where inkjet printhead assembly 12 and ink supply assembly 14 are housed together in an inkjet cartridge, reservoir 15 includes a local reservoir located within the cartridge and/or a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly. As such, mounting assembly 16 includes a carriage for moving inkjet printhead assembly 12 relative to media transport assembly 18 to scan print medium 19. In another embodiment, inkjet printhead assembly 12 is a non-scanning type printhead assembly. As such, mounting assembly 16 fixes inkjet printhead assembly 12 at a prescribed position relative to media transport assembly 18. Thus, media transport assembly 18 positions print medium 19 relative to inkjet printhead assembly 12.

Electronic controller 20 communicates with inkjet printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of inkjet printhead assembly 12 including timing control for ejection of ink drops from nozzles 13. As such, electronic controller 20 defines a pattern of ejected ink drops which form characters, symbols, and/or other graphics or images on print medium 19. Timing control and, therefore, the pattern of ejected ink drops, is determined by the print job commands and/or command parameters. In one embodiment, logic and drive circuitry forming a portion of electronic controller 20 is located on inkjet printhead assembly 12. In another embodiment, logic and drive circuitry is located off inkjet printhead assembly 12.

Figure 2:
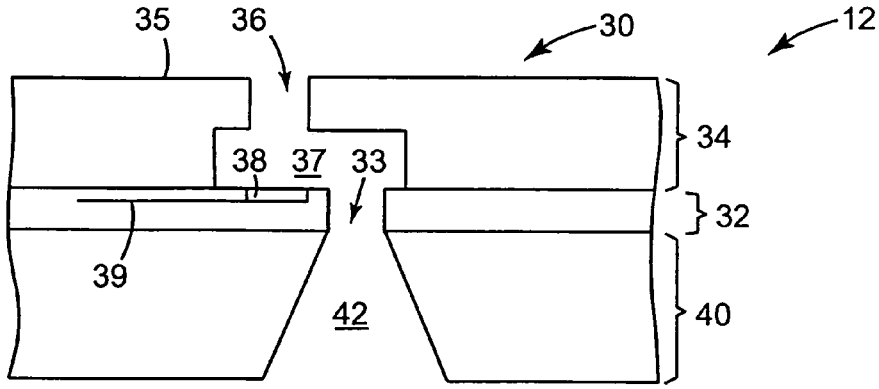
FIG. 2 is a schematic cross-sectional view illustrating one embodiment of a portion of a fluid ejection device according to the present invention.

FIG. 2 illustrates one embodiment of a portion of inkjet printhead assembly 12. Inkjet printhead assembly 12 includes an array of printing or drop ejecting elements 30. Drop ejecting elements 30 are formed on a substrate 40 which has an ink feed slot 42 formed therein. As such, ink feed slot 42 provides a supply of liquid ink to drop ejecting elements 30. Each drop ejecting element 30 includes a thin-film structure 32, an orifice layer 34, and a firing resistor 38. Thin-film structure 32 has an ink feed channel 33 formed therein which communicates with ink feed slot 42 of substrate 40. Orifice layer 34 has a front face 35 and a nozzle opening 36 formed in front face 35. Orifice layer 34 also has a nozzle chamber 37 formed therein which communicates with nozzle opening 36 and ink feed channel 33 of thin-film structure 32. Firing resistor 38 is positioned within nozzle chamber 37 and includes leads 39 which electrically couple firing resistor 38 to a drive signal and ground.

During printing, ink flows from ink feed slot 42 to nozzle chamber 37 via ink feed channel 33. Nozzle opening 36 is operatively associated with firing resistor 38 such that droplets of ink are ejected from nozzle chamber 37 through nozzle opening 36 (e.g., normal to the plane of firing resistor 38) and toward a print medium upon energization of firing resistor 38.

Example embodiments of inkjet printhead assembly 12 include a thermal printhead, a piezoelectric printhead, a flex-tensional printhead, or any other type of fluid ejection device known in the art. In one embodiment, inkjet printhead assembly 12 is a fully integrated thermal inkjet printhead. As such, substrate 40 is formed, for example, of silicon, glass, or a stable polymer, and thin-film structure 32 is formed by one or more passivation or insulation layers of silicon dioxide, silicon carbide, silicon nitride, tantalum, poly-silicon glass, or other suitable material. Thin-film structure 32 also includes a conductive layer which defines firing resistor 38 and leads 39. The conductive layer is formed, for example, by aluminum, gold, tantalum, tantalum-aluminum, or other metal or metal alloy.

FIGS. 3A-3D illustrate one embodiment of an opening 50 through a substrate 60. Substrate 60 has a first side 62 and a second side 64. Second side 64 is opposite of first side 62 and, in one embodiment, oriented substantially parallel with first side 62. Opening 50 communicates with first side 62 and second side 64 of substrate 60 so as to provide a channel or passage through substrate 60.

In one embodiment, substrate 60 represents substrate 40 of inkjet printhead assembly 12 and opening 50 represents ink feed slot 42 formed in substrate 40. As such, drop ejecting elements 30 of inkjet printhead assembly 12 are formed on first side 62 of substrate 60. Thus, first side 62 forms a frontside of substrate 60 and second side 64 forms a backside of substrate 60 with ink flowing through opening 50 and, therefore, substrate 60 from the backside to the frontside. Accordingly, opening 50 provides a fluidic channel for the communication of ink with drop ejecting elements 30 through substrate 60.

Figure 3A:
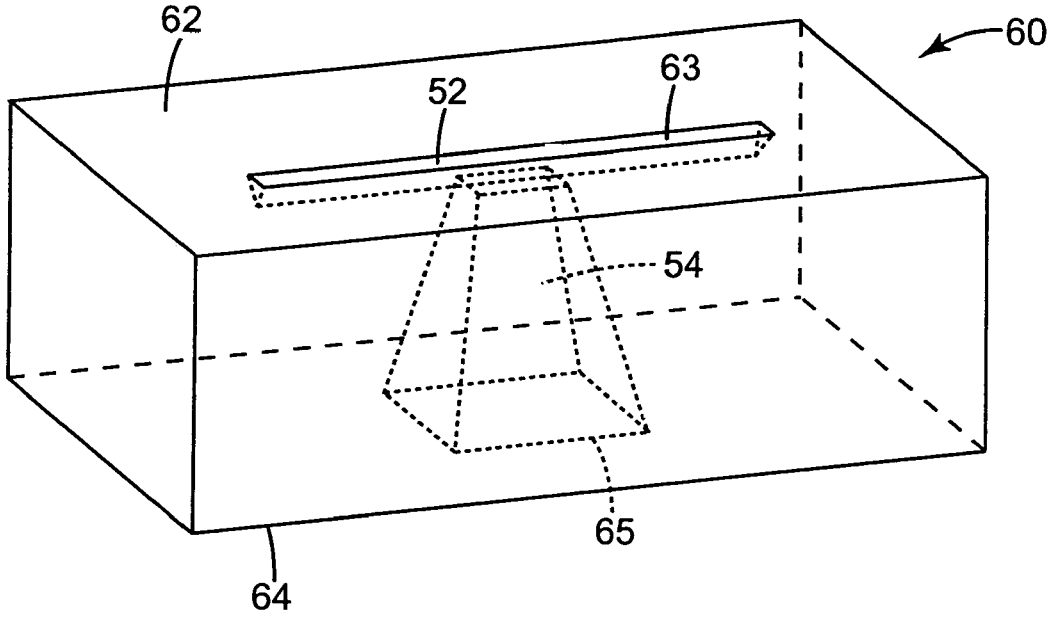
FIGS. 3A-3C illustrate one embodiment of an opening through a substrate according to the present invention.

As illustrated in the embodiment of FIG. 3A, opening 50 includes a first portion 52 and a second portion 54. First portion 52 of opening 50 is formed in and communicates with first side 62 of substrate 60 and second portion 54 of opening 50 is formed in and communicates with second side 64 of substrate 60. As such, first portion 52 forms a hole 63 in first side 62 and second portion 54 forms a hole 65 in second side 64. First portion 52 and second portion 54 communicate with each other so as to form a portion of opening 50 through substrate 60.

In one embodiment, first portion 52 of opening 50 is in the form of an elongated slot or channel and has a substantially V-shaped or inverted, triangular-shaped cross-section. In another embodiment, first portion 52 of opening 50 has a substantially trapezoidal-shaped cross-section. In addition, in one embodiment, second portion 54 of opening 50 is in the form of a polyhedron and has a substantially triangular-shaped cross-section. In another embodiment, second portion 54 of opening 50 has a substantially trapezoidal-shaped cross-section. Preferably, a valley of first portion 52 communicates with a tip of second portion 54. As such, first portion 52 and second portion 54 communicate or connect to form a portion of opening 50 through substrate 60.

Figure 3B:
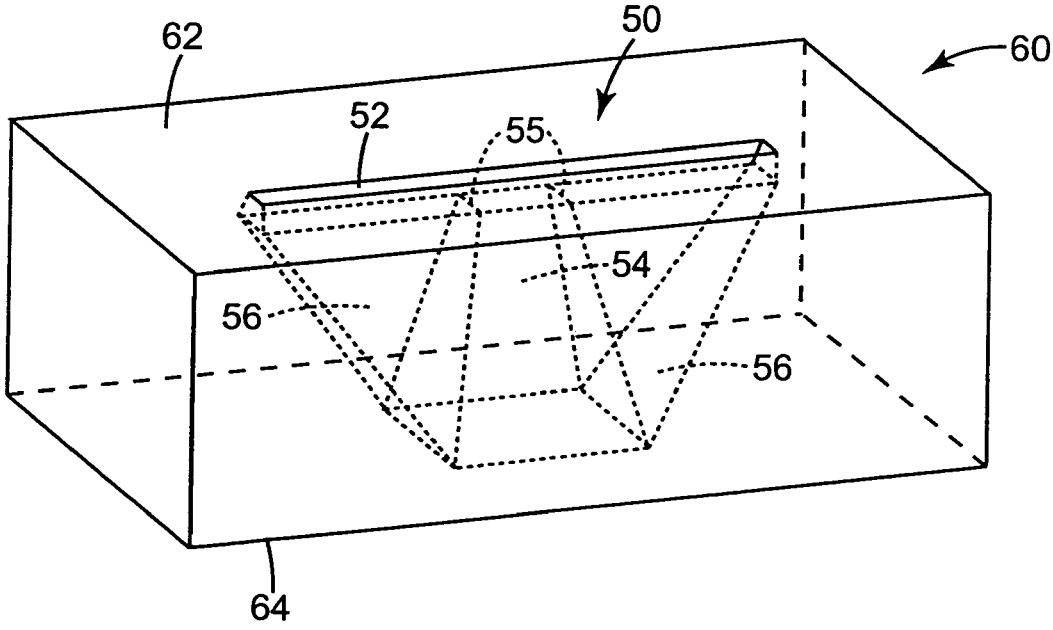

As illustrated in the embodiment of FIG. 3B, opening 50 also includes a third portion 56. Third portion 56 of opening 50 is formed in substrate 60 and extends between first portion 52 and second portion 54 of opening 50. More specifically, third portion 56 extends from an interface 55 formed between first portion 52 and second portion 54 toward second side 64. One embodiment of forming third portion 56 by overetching first portion 52 and second portion 54 is illustrated and described below with reference to FIGS. 5D-5F.

One side of third portion 56 communicates with first portion 52, an adjacent side of third portion 56 communicates with second portion 54, and another side of third portion 56 extends from second side 64 toward first side 62 to first portion 52. Thus, third portion 56 communicates with first portion 52 and second portion 54 so as to form an additional portion of opening 50 through substrate 60. In one embodiment, third portion 56 extends from two opposing sides of second portion 54. It is, however, within the scope of the present invention for third portion 56 to extend only from one side of second portion 54.

In one embodiment, as described below, third portion 56 is formed by etching along a low-index plane of substrate 60. As such, third portion 56 of opening 50 has a substantially triangular-shaped profile and a substantially trapezoidal-shaped cross-section which diminishes in size between second portion 54 and first portion 52. More specifically, the substantially trapezoidal-shaped cross-section of third portion 56 diminishes in size from a side of second portion 54 of opening 50 toward an end of first portion 52 of opening 50. As such, a base of third portion 56 communicates with a side of second portion 54 and a tip of third portion 56 communicates with first portion 52.

Figure 3C:
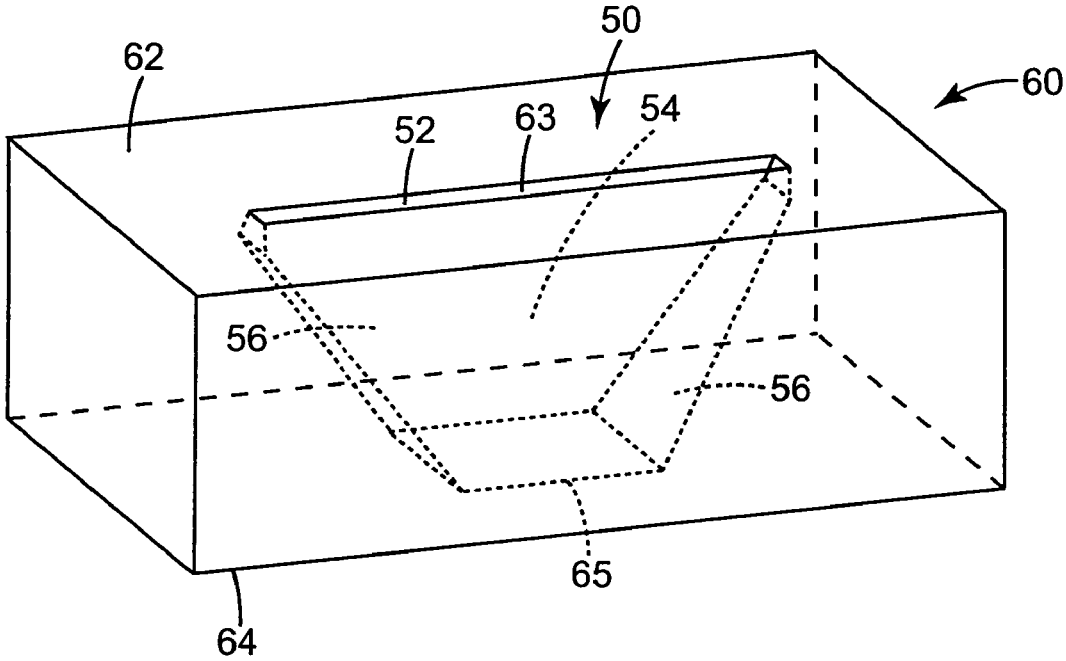

As illustrated in the embodiment of FIG. 3C, first portion 52, second portion 54, and third portion 56 communicate with each other to form opening 50 through substrate 60. More specifically, first portion 52, second portion 54, and third portion 56 combine to communicate hole 63 in first side 62 with hole 65 in second side 64. As such, opening 50 provides a channel or passage through substrate 60.

Figure 3D:
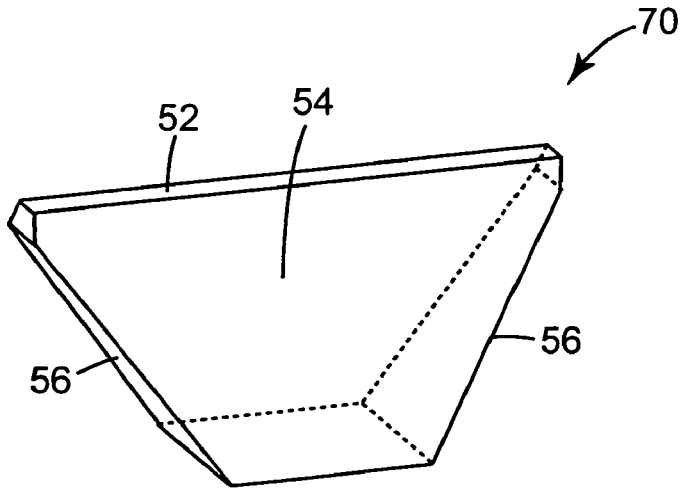
FIG. 3D illustrates one embodiment of a casting of the opening of FIG. 3C.

For clarity of the invention, a casting 70 of opening 50 through substrate 60 is illustrated in the embodiment of FIG. 3D. With casting 70, the combined opening 50 created by first portion 52, second portion 54, and third portion 56 is illustrated in solid form.

First portion 52, second portion 54, and third portion 56 of opening 50 are formed according to an embodiment of the present invention, as described below. First portion 52 may be formed before, after, and/or at the same time as second portion 54 or second portion 54 may be formed before, after, and/or at the same time as first portion 52. In one embodiment, first portion 52 of opening 50 is formed first and self-terminates within substrate 60. As such, second portion 54 of opening 50 is formed second so as to communicate with first portion 52. In another embodiment, second portion 54 of opening 50 is formed first and self-terminates within substrate 60. As such, first portion 52 of opening 50 is formed second so as to communicate with second portion 54. In another embodiment, first portion 52 and second portion 54 of opening 50 are formed at the same time. As such, first portion 52 of opening 50 self-terminates within substrate 60 and second portion 54 of opening 50 is formed so as to communicate with first portion 52.

Figure 4A:
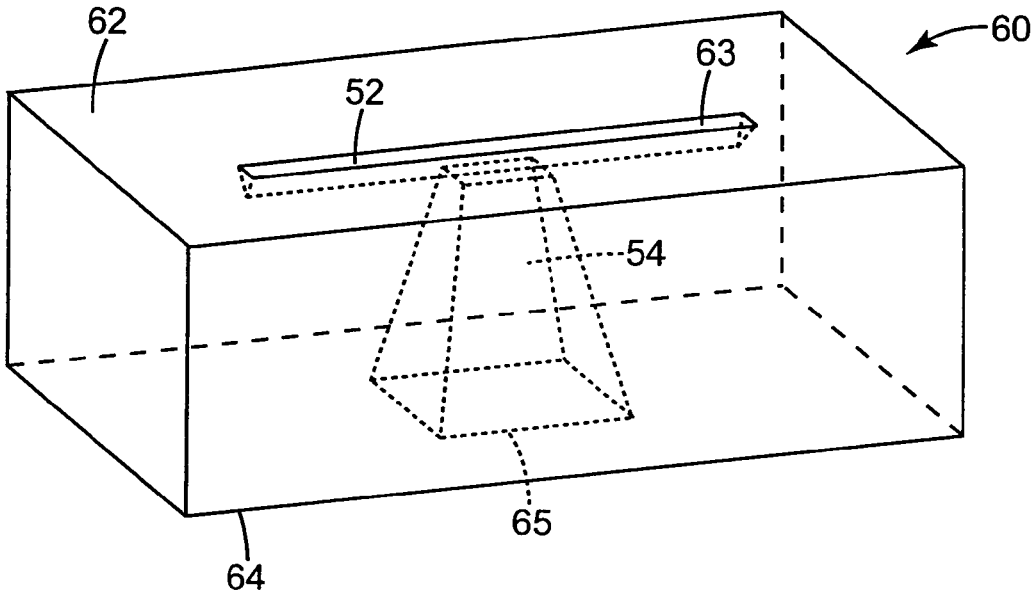
FIGS. 4A-4C illustrate another embodiment of an opening through a substrate according to the present invention.

FIGS. 4A-4D illustrate another embodiment of opening 50 through substrate 60. Opening 50', similar to opening 50, communicates with first side 62 and second side 64 of substrate 60 so as to provide a channel or passage through substrate 60. As illustrated in the embodiment of FIG. 4A, opening 50' includes first portion 52 and second portion 54, as described above with reference to opening 50.

Figure 4B:
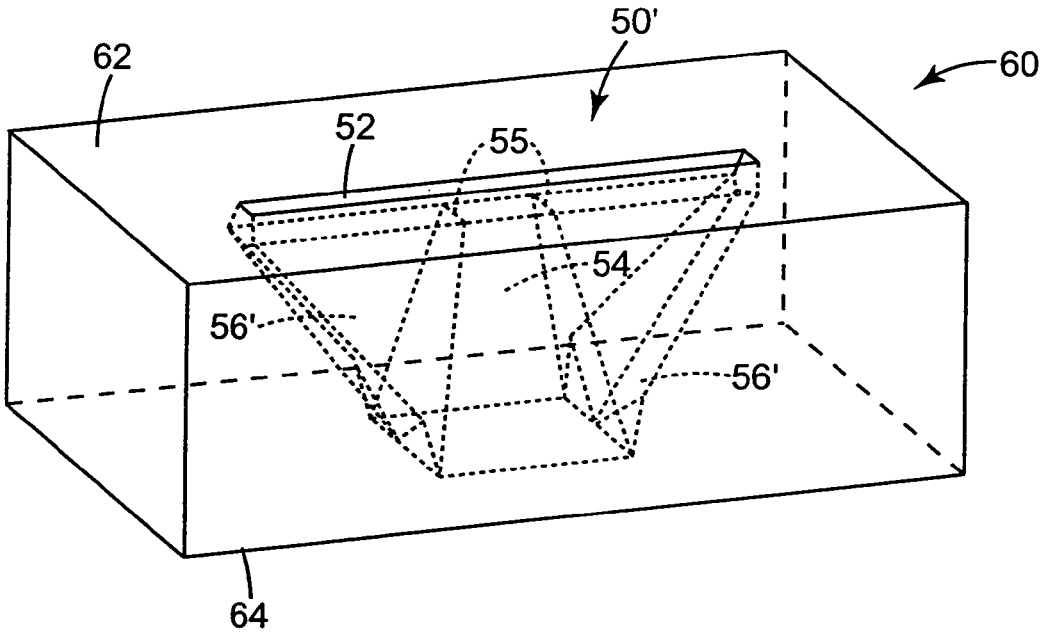

As illustrated in the embodiment of FIG. 4B, opening 50' also includes a third portion 56'. Third portion 56' of opening 50', similar to third portion 56 of opening 50, is formed in substrate 60 and extends between first portion 52 and second portion 54 of opening 50'. More specifically, third portion 56' extends from interface 55 formed between first portion 52 and second portion 54 toward second side 64. One embodiment of forming third portion 56' by overetching first portion 52 and second portion 54 is illustrated and described below with reference to FIGS. 6D-6F.

One side of third portion 56' communicates with first portion 52, an adjacent side of third portion 56' communicates with second portion 54, and another side of third portion 56' extends from second side 64 toward first side 62 to first portion 52. Thus, third portion 56' communicates with first portion 52 and second portion 54 so as to form an additional portion of opening 50' through substrate 60. In one embodiment, third portion 56' extends from two opposing sides of second portion 54. It is, however, within the scope of the present invention for third portion 56' to extend only from one side of second portion 54.

In one embodiment, as described below, third portion 56' is formed by etching along a high-index plane of substrate 60. As such, third portion 56' of opening 50' is in the form of a polyhedron oriented or tipped at an angle and having a substantially diamond-shaped base. Thus, third portion 56' has a substantially diamond-shaped cross-section which diminishes in size between second portion 54 and first portion 52. More specifically, the substantially diamond-shaped cross-section of third portion 56' diminishes in size from a side of second portion 54 of opening 50' toward an end of first portion 52 of opening 50'. As such, a base of third portion 56' communicates with a side of second portion 54 and a tip of third portion 56' communicates with first portion 52. In addition, third portion 56' forms a compound surface between first portion 52 and second portion 54 of opening 50'. The compound surface includes, for example, opposing substantially V-shaped surfaces which extend between and diminish from a side of second portion 54 toward an end of first portion 52.

Figure 4C:
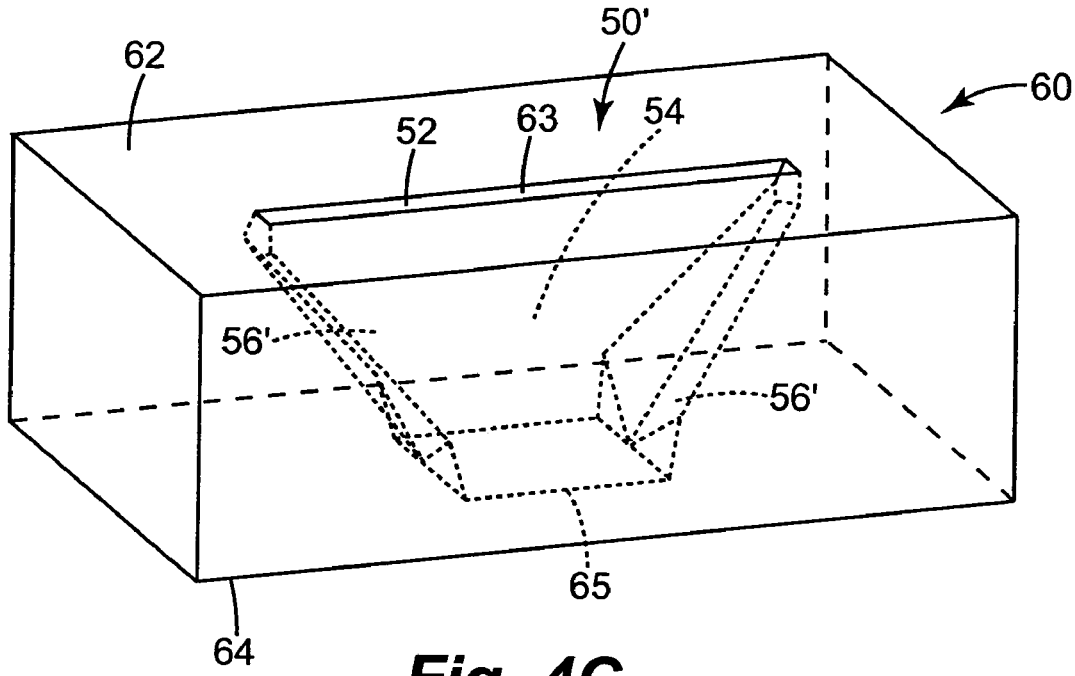

As illustrated in the embodiment of FIG. 4C, first portion 52, second portion 54, and third portion 56' communicate with each other to form opening 50' through substrate 60. More specifically, first portion 52, second portion 54, and third portion 56' combine to communicate hole 63 in first side 62 with hole 65 in second side 64. As such, opening 50' provides a channel or passage through substrate 60.

Figure 4D:
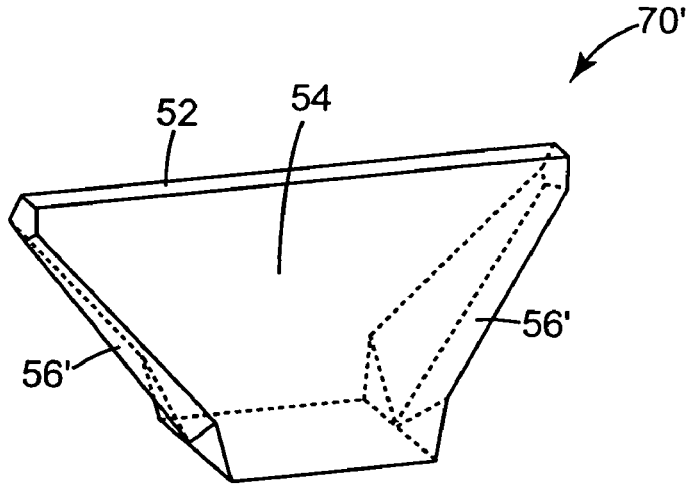
FIG. 4D illustrates one embodiment of a casting of the opening of FIG. 4C.

For clarity of the invention, a casting 70' of opening 50' through substrate 60 is illustrated in the embodiment of FIG. 4D. With casting 70', the combined opening 50' created by first portion 52, second portion 54, and third portion 56' is illustrated in solid form.

First portion 52, second portion 54, and third portion 56' of opening 50' are formed according to an embodiment of the present invention, as described below. In addition, first portion 52 may be formed before, after, and/or at the same time as second portion 54 or second portion 54 may be formed before, after, and/or at the same time as first portion 52, as described above with reference to opening 50.

FIGS. 5A-5F and FIGS. 6A-6F illustrate one embodiment of forming opening 50 and opening 50', respectively, through substrate 60. FIGS. 5A-5F and FIGS. 6A-6F each include schematic cross-sectional end and side views of forming opening 50 and opening 50', respectively, through substrate 60. Accordingly, the schematic side views represent cross-sectional views in a first direction and the schematic end views represent cross-sectional views in a second direction substantially perpendicular to the first direction. While only one opening 50 and one opening 50' is illustrated as being formed, it is understood that multiple openings 50 and/or 50' may be formed through substrate 60.

In one embodiment, substrate 60 is a silicon substrate and openings 50 and 50' are formed in substrate 60 by chemical etching. Preferably, openings 50 and 50' are formed using anisotropic chemical etch processes. More specifically, the chemical etch processes are wet etch processes and use a wet anisotropic etchant such as tetra-methyl ammonium hydroxide (TMAH), potassium hydroxide (KOH), or other alkaline etchant. As such, the geometry of openings 50 and 50' through substrate 60 is defined by crystalline planes of the silicon substrate, as described below. Different crystalline planes of the silicon substrate are etched, for example, by varying a concentration of the wet anisotropic etchant.

Figure 5A:
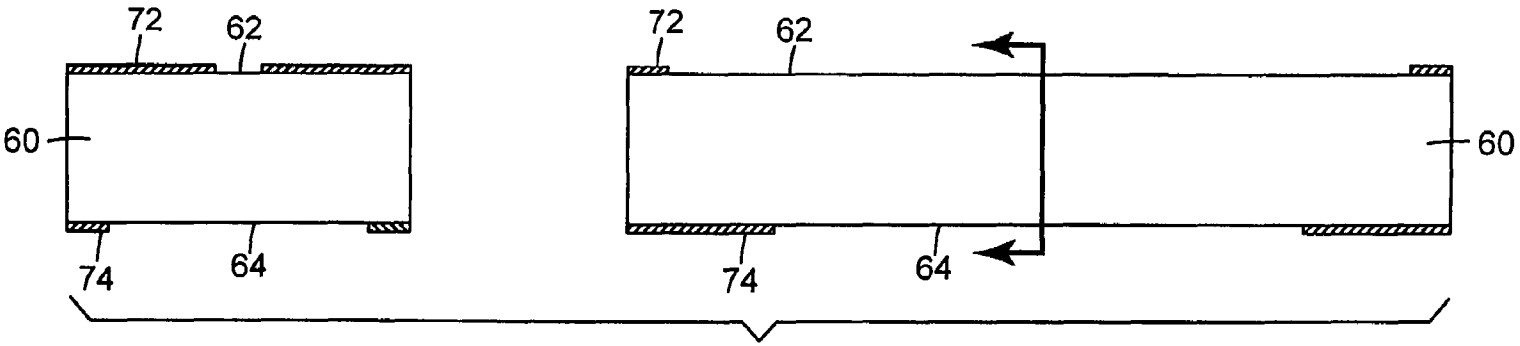
FIGS. 5A-5F are schematic cross-sectional end and side views illustrating one embodiment of forming an opening through a substrate according to the present invention.
Figure 6A:
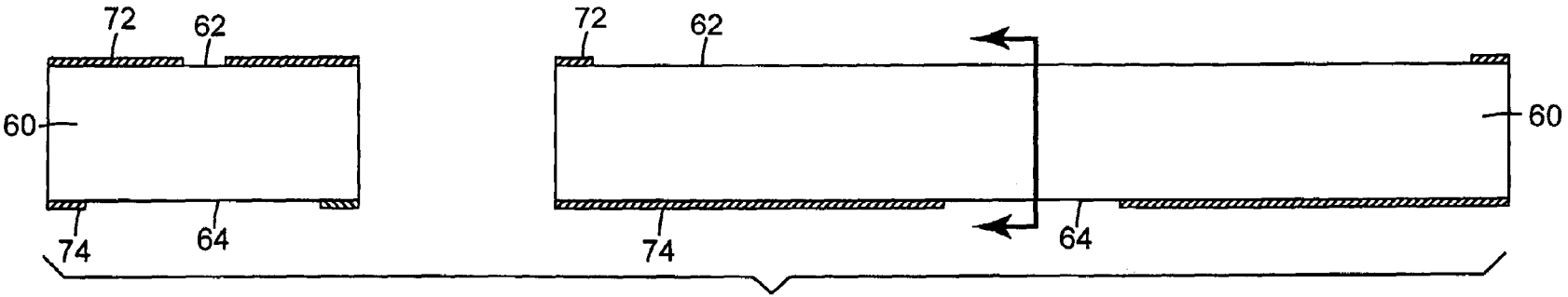
FIGS. 6A-6F are schematic cross-sectional end and side views illustrating another embodiment of forming an opening through a substrate according to the present invention.

As illustrated in the embodiments of FIGS. 5A and 6A, before substrate 60 is etched, masking layers 72 and 74 are formed on substrate 60. More specifically, masking layer 72 is formed on first side 62 of substrate 60 and masking layer 74 is formed on second side 64 of substrate 60. Masking layers 72 and 74 are used to selectively control or block etching of first side 62 and second side 64, respectively. As such, masking layer 72 is formed along first side 62 of substrate 60 and patterned to expose areas of first side 62 and define where substrate 60 is to be etched to form hole 63 and first portion 52 of openings 50 and 50'. In addition, masking layer 74 is formed along second side 64 of substrate 60 and patterned to expose areas of second side 64 and define where substrate 60 is to be etched to form hole 65 and second portion 54 of openings 50 and 50'. It is understood that masking layers 72 and/or 74 may include one or more layers formed on first side 62 and second side 64, respectively.

In one embodiment, masking layers 72 and 74 are formed by deposition and patterned by photolithography and etching to define exposed portions of first side 62 and second side 64 of substrate 60. More specifically, masking layer 72 is patterned to outline hole 63 in first side 62 and first portion 52 of openings 50 and 50' to be formed in substrate 60 from first side 62. In addition, masking layer 74 is patterned to outline hole 65 in second side 64 and second portion 54 of openings 50 and 50' to be formed in substrate 60 from second side 64. Masking layers 72 and 74 are each formed of a material which is resistant to etchant used for etching substrate 60, as described above. Examples of a material suitable for masking layers 72 and 74 include silicon dioxide or silicon nitride.

Figure 5B:
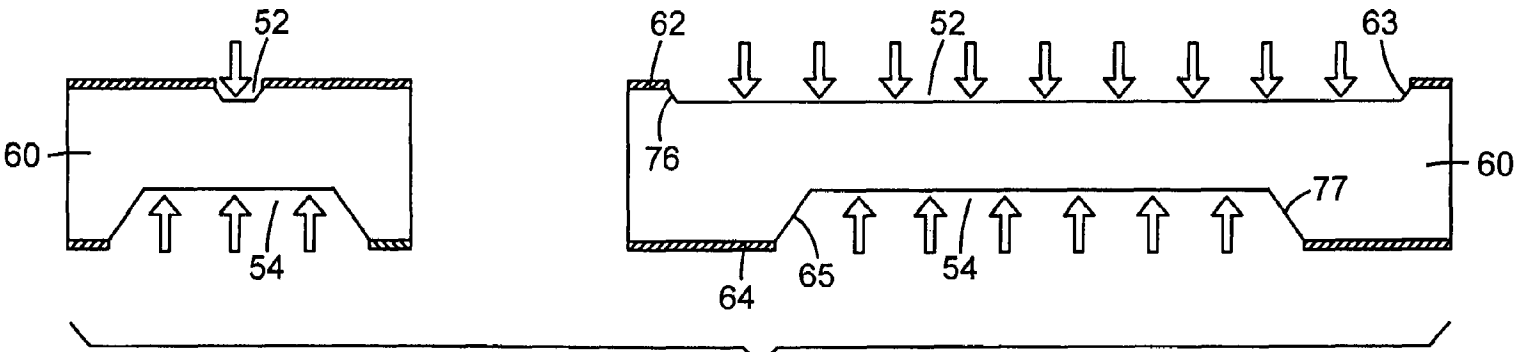
Figure 6B:
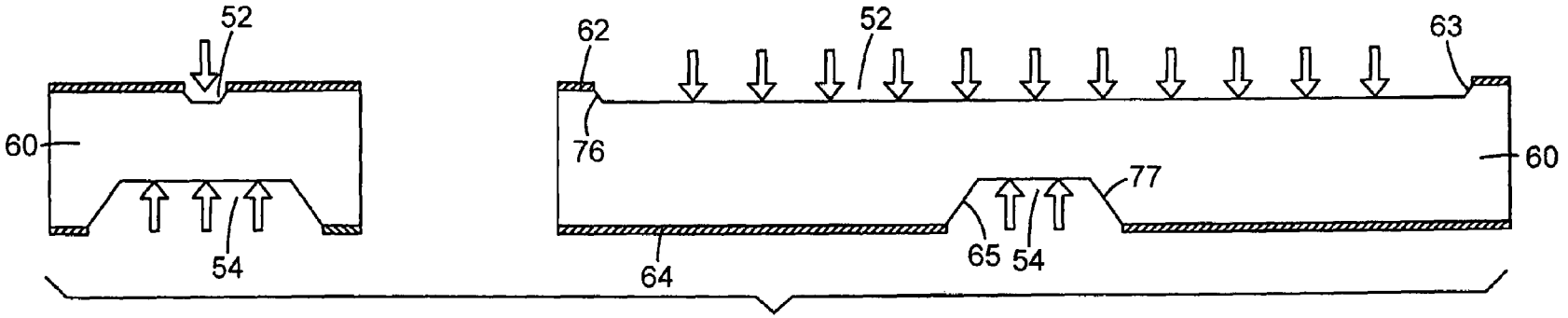

Next, as illustrated in the embodiments of FIGS. 5B and 6B, hole 63 is etched in first side 62 of substrate 60 and hole 65 is etched in second side 64 of substrate 60. As such, hole 63 is formed as a portion of first portion 52 of openings 50 and 50' and hole 65 is formed as a portion of second portion 54 of openings 50 and 50'. Thus, first portion 52 of openings 50 and 50' is formed by etching substrate 60 from first side 62 toward second side 64 and second portion 54 of openings 50 and 50' is formed by etching substrate 60 from second side 64 toward first side 62.

Preferably, first portion 52 and second portion 54 of openings 50 and 50' are formed using anisotropic wet etch processes, as described above. As such, first portion 52 of openings 50 and 50' follows a crystalline plane 76 of substrate 60 and second portion 54 of openings 50 and 50' follows a crystalline plane 77 of substrate 60. In one embodiment, substrate 60 has a <100> Si crystal orientation and the wet anisotropic etches of first portion 52 and second portion 54 follow <111> Si planes of substrate 60. As such, crystalline planes 76 and 77 include <111> Si planes of substrate 60. Thus, sides of first portion 52 of openings 50 and 50' and sides of second portion 54 of openings 50 and 50' are oriented at an angle of approximately 54 degrees. The <111> Si planes of substrate 60 are binary ("0", "1") planes and represent low-index planes of substrate 60. Other examples of low-index planes which may be used when using wafers having different crystal orientations include <100> and <110> Si planes.

Figure 5C:
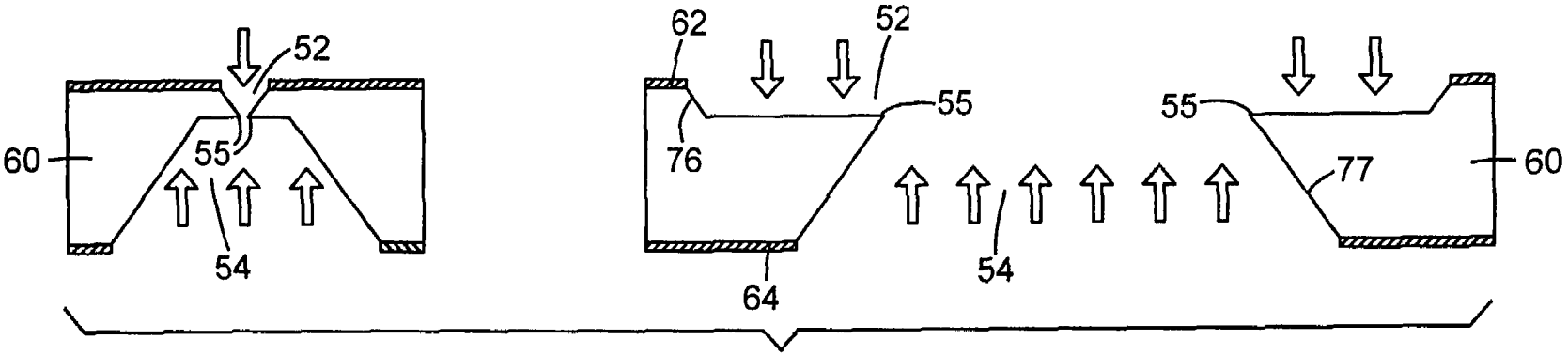
Figure 6C:
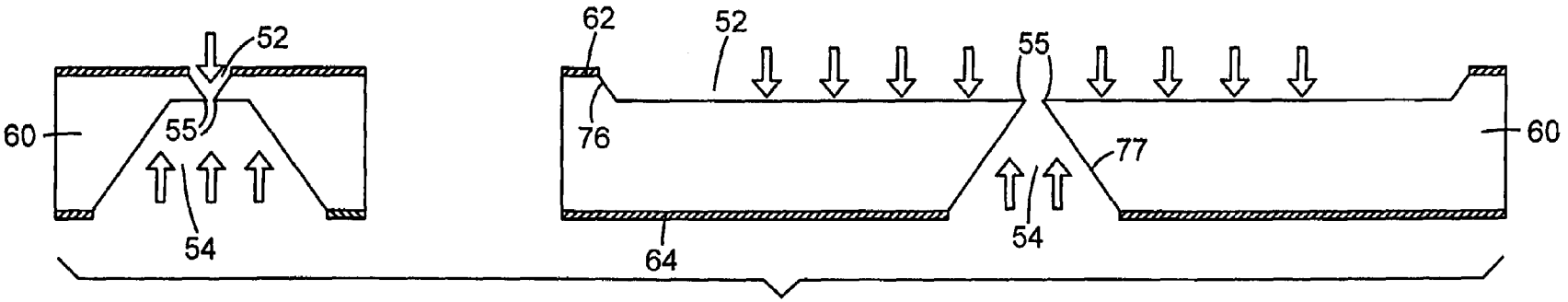

As illustrated in the embodiments of FIGS. 5C and 6C, etching into substrate 60 from first side 62 toward second side 64 and/or from second side 64 toward first side 62 continues such that first portion 52 of openings 50 and 50' and second portion 54 of openings 50 and 50' connect or communicate. As such, interface 55 is formed between first portion 52 and second portion 54. In addition, first portion 52 of openings 50 and 50' converges from first side 62 toward second side 64 and second portion 54 of openings 50 and 50' converges from second side 64 toward first side 62. As such, first portion 52 of openings 50 and 50' is widest at first side 62 and second portion 54 of openings 50 and 50' is widest at second side 64. As described above, first portion 52 of openings 50 and 50' may be formed before, after, and/or at the same time as second portion 54, and second portion 54 of openings 50 and 50' may be formed before, after, and/or at the same time as first portion 52.

Figure 5D:
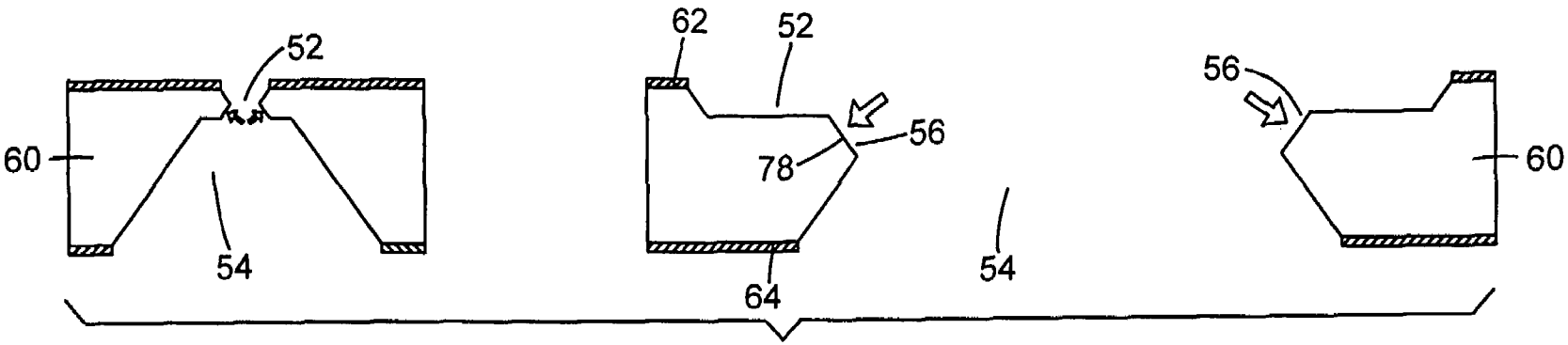
Figure 6D:
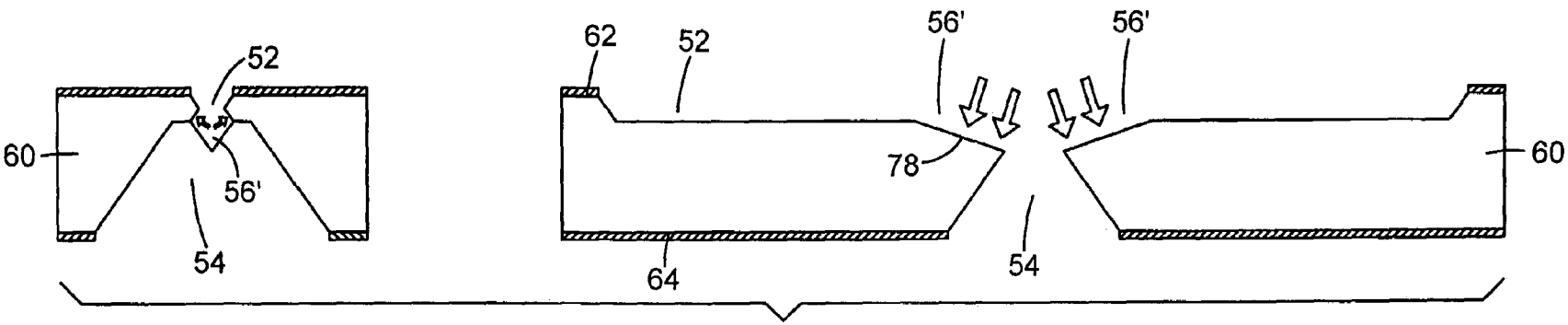

Next, as illustrated in the embodiments of FIGS. 5D and 6D, third portion 56 of opening 50 and third portion 56' of opening 50' are formed by etching substrate 60 at interface 55 between first portion 52 and second portion 54 of opening 50 and opening 50', respectively. In one embodiment, substrate 60 is etched from interface 55 toward first side 62 of substrate 60 and from interface 55 toward second side 64 of substrate 60. More specifically, third portions 56 and 56' are each formed by etching substrate 60 from interface 55 toward first side 62 at an angle relative to first side 62, as illustrated in the end view of FIGS. 5D and 6D, and from interface 55 toward second side 64 at an angle relative to second side 64, as illustrated in the side view of FIGS. 5D and 6D. As such, first portion 52 and second portion 54 are each overetched to form third portions 56 and 56'. Preferably, the angle at which third portions 56 and 56' are etched is non-parallel and non-orthogonal to first side 62 and/or second side 64.

Preferably, third portion 56 of opening 50 and third portion 56' of opening 50' are each formed using an anisotropic etch process, as described above. As such, third portion 56 of opening 50 and third portion 56' of opening 50' each follow a crystalline plane 78 of substrate 60. In one embodiment, the wet anisotropic etch of third portion 56 follows <111> Si planes of substrate 60 such that sides of third portion 56 of opening 50 are oriented at an angle of approximately 54 degrees. Thus, crystalline plane 78 of third portion 56 includes <111> Si planes of substrate 60. The <111> Si planes of substrate 60 are binary planes and represent low-index planes of substrate 60. In one embodiment, the wet anisotropic etch of third portion 56' follows <310> Si planes of substrate 60 such that sides of third portion 56' of opening 50' are oriented at an angle of approximately 18 degrees. Thus, crystalline plane 78 of third portion 56' includes <310> Si planes of substrate 60. The <310> Si planes of substrate 60 are non-binary planes and represent high-index planes of substrate 60. Other examples of high-index planes include <210>, <311>, <711>, and <510> Si planes.

Figure 5E:
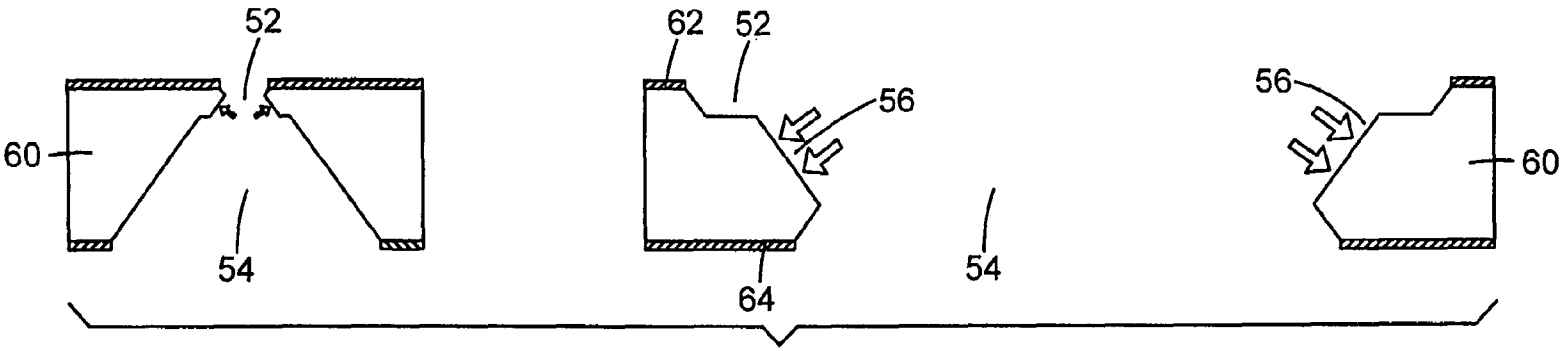
Figure 6E:
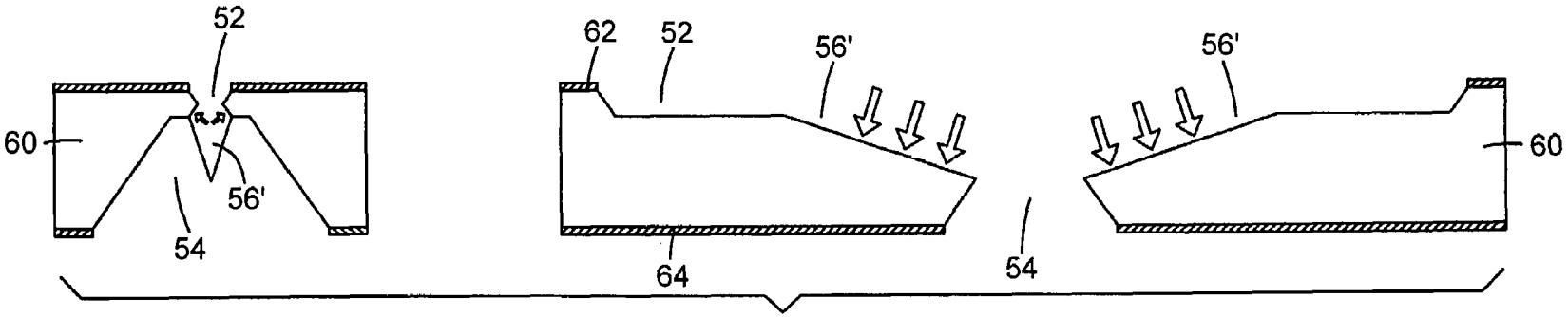

As illustrated in the embodiments of FIGS. 5E and 6E, etching into substrate 60 from interface 55 toward first side 62 continues at an angle to first side 62 and etching into substrate 60 from interface 55 toward second side 64 continues at an angle to second side 64 of substrate 60. By etching third portion 56 of opening 50 and third portion 56' of opening 50' along one or more opposing sides of first portion 52 and second portion 54 of openings 50 and 50', respectively, first portion 52 and second portion 54 of openings 50 and 50' are overetched.

Figure 5F:
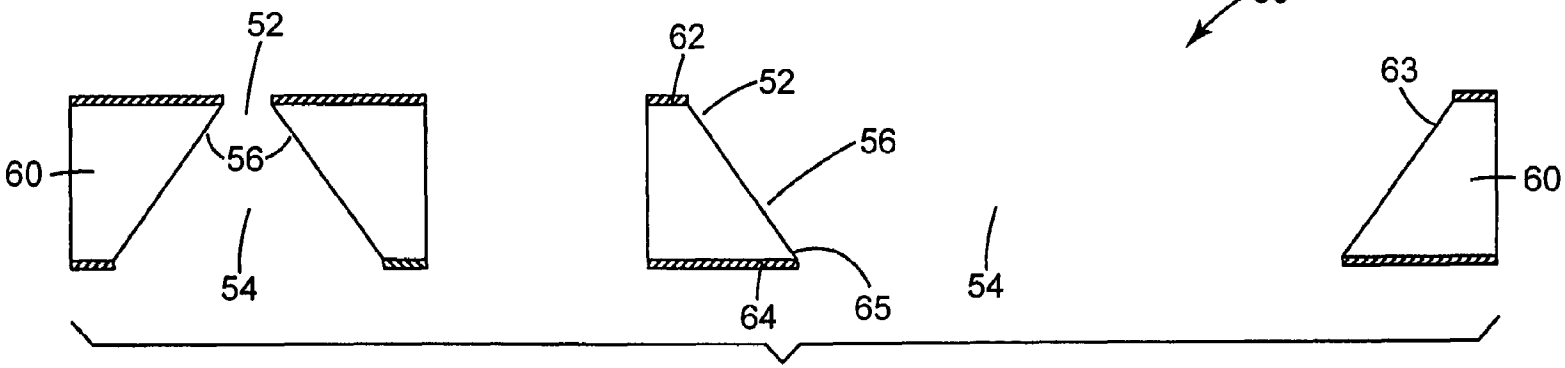
Figure 6F:
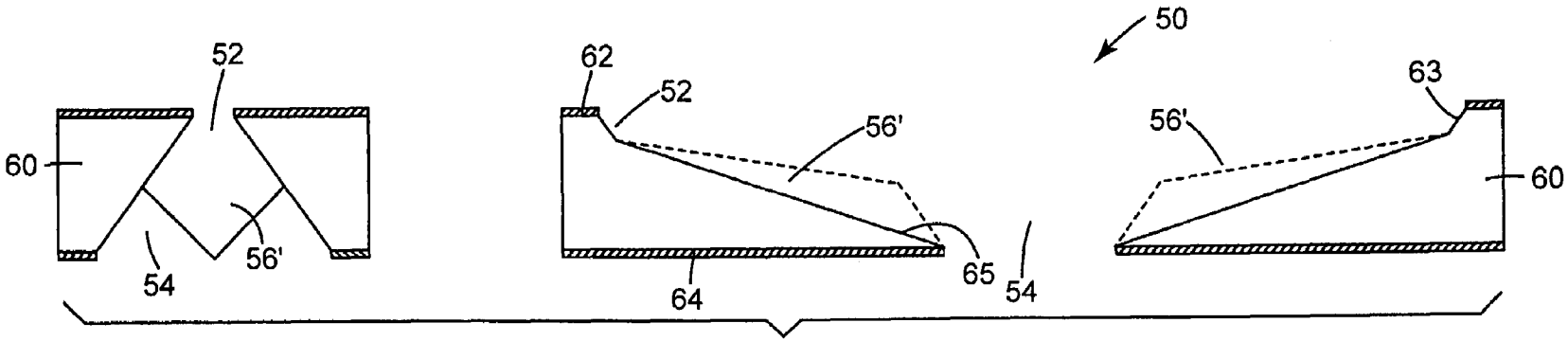

As illustrated in the embodiments of FIGS. 5F and 6F, etching into substrate 60 from interface 55 toward first side 62 and second side 64 continues such that third portion 56 of opening 50 and third portion 56' of opening 50' each communicate second side 64 of substrate 60 with first portion 52 of openings 50 and 50', respectively. As such, third portion 56 of opening 50 and third portion 56' of opening 50' each communicate hole 65 in second side 64 with first portion 52 of openings 50 and 50', respectively, and, therefore, hole 63 in first side 62. Preferably, etching of third portion 56 of opening 50 and third portion 56' of opening 50' at an angle from interface 55 toward first side 62 and second side 64 minimizes lateral or horizontal areas of openings 50 and 50', respectively, through substrate 60 from second side 64 to first side 62.

In one embodiment, etching of third portion 56 of opening 50 and third portion 56' of opening 50' at an angle from interface 55 toward first side 62 and second side 64 includes, in a first direction, diverging second portion 54 of openings 50 and 50' from second side 64 toward first side 62 of substrate 60 and, in a second direction substantially perpendicular to the first direction, converging second portion 54 of openings 50 and 50' from second side 64 toward first side 62 of substrate 60. As such, in one direction, second portion 54 of openings 50 and 50' is widest toward first side 62. Accordingly, in one direction, as illustrated in the side view of FIGS. 5F and 6F, openings 50 and 50' diverge from second side 64 toward first side 62 and, in another direction, as illustrated in the end view of FIGS. 5F and 6F, openings 50 and 50' converge from second side 64 toward first side 62. Thus, in one direction, hole 65 is wider than hole 63. In another direction, however, hole 63 is longer than hole 65.

Figure 8:
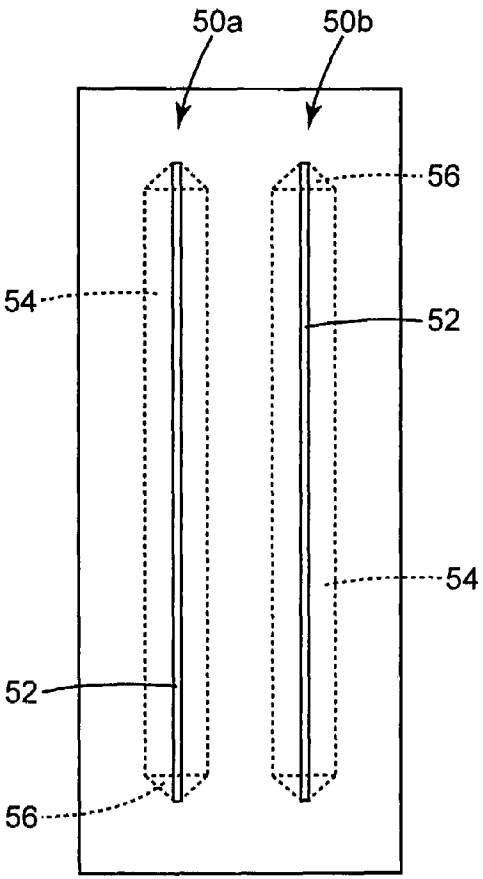
FIG. 8 is a top view illustrating one embodiment of a substrate including a pair of openings therethrough according to the present invention.
Figure 7:
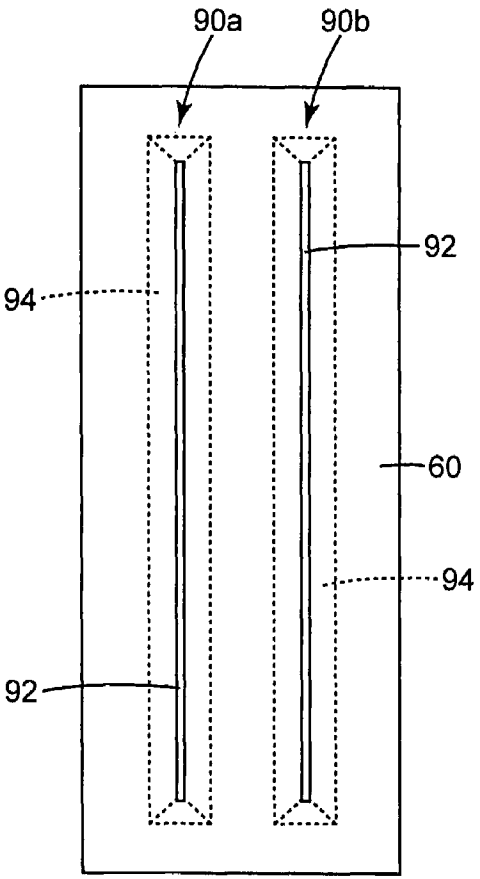
Fig. 7 PRIOR ART
FIG. 7 is a top view illustrating one embodiment of a substrate including a pair of conventional openings therethrough.

FIGS. 7 and 8 each illustrate a pair of openings formed through substrate 60 according to conventional methods and according to the present invention, respectively. As illustrated in FIG. 7, openings 90*a* and 90*b* are formed through substrate 60 according to conventional methods including conventional etching techniques, and each include a slot 92 formed in a first or frontside of substrate 60 and a slot 94 formed in a second or backside of substrate 60. By using conventional etching techniques, however, slot 94 is formed as a single elongated slot or trench.

Unfortunately, with slot 94 being formed as a single elongated trench, a significant amount of material is removed from substrate 60 including, more specifically, the backside of substrate 60. As such, strength of substrate 60 is compromised and workable or useful area of the backside of substrate 60 is reduced. In addition, to accommodate multiple openings 90*a* and 90*b* in substrate 60, openings 90*a* and 90*b* must be spaced a sufficient distance from each other and from the ends of substrate 60 to accommodate substrate design restraints or requirements such as strength and backside support and/or adhesion area between and/or around openings 90*a* and 90*b*.

As illustrated in the embodiment of FIG. 8, however, openings 50*a* and 50*b* formed through substrate 60 according to the present invention each include first portion 52 formed from first side 62 of substrate 60, second portion 54 formed from second side 64 of substrate 60, and third portion 56 (including third portion 56') formed between second portion 54 and first portion 52, as described above. As such, first portion 52 of each opening 50*a* and 50*b* forms a single elongated slot in first side 62 of substrate 60 and second portion 54 of each opening 50*a* and 50*b* forms a shorter slot in second side 64 of substrate 60.

By forming opening 50 (including opening 50') in substrate 60 with first portion 52, second portion 54, and third portion 56 (including third portion 56'), a slot of reduced size can feed a single elongated slot. More specifically, by overetching second portion 54 of opening 50 and forming third portion 56 of opening 50 between second portion 54 and first portion 52, hole 65 in second side 64 can be shorter than hole 63 in first side 62 since, in one direction, third portion 56 diverges or increases a dimension of opening 50 from second side 64 toward first side 62. As such, extension of the ends of hole 65 beyond the ends of hole 63 is eliminated. Accordingly, a dimension or area between an end of hole 63 in first side 62 and an end of substrate 60, commonly referred to as headland, can be reduced since the ends of hole 65 no longer extend beyond the ends of hole 63.

In addition, due to the converging or decreasing dimension of opening 50 (including opening 50') in one axis from second side 64 of substrate 60 toward first side 62 of substrate 60, and the diverging or increasing dimension of opening 50 (including opening 50') in another axis from second side 64 of substrate 60 toward first side 62 of substrate 60, lateral flow areas which are conducive to forming bubble trap areas are avoided in opening 50. Thus, by forming opening 50 in substrate 60 with first portion 52, second portion 54, and third portion 56 extending between second portion 54 and first portion 52, opening 50 is outgassing friendly and provides no apparent bubble traps.

Figure 9A:
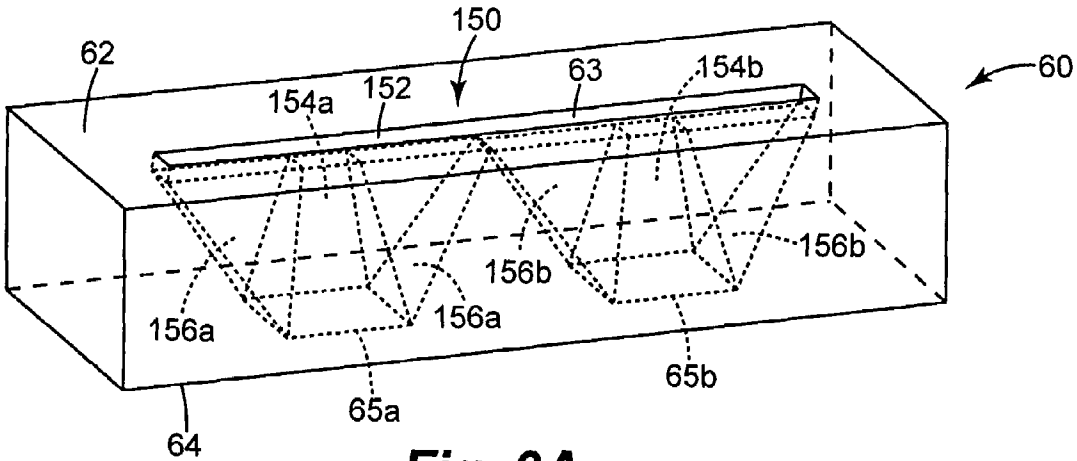
FIGS. 9A and 9B illustrate another embodiment of an opening through a substrate according to the present invention.
Figure 9B:
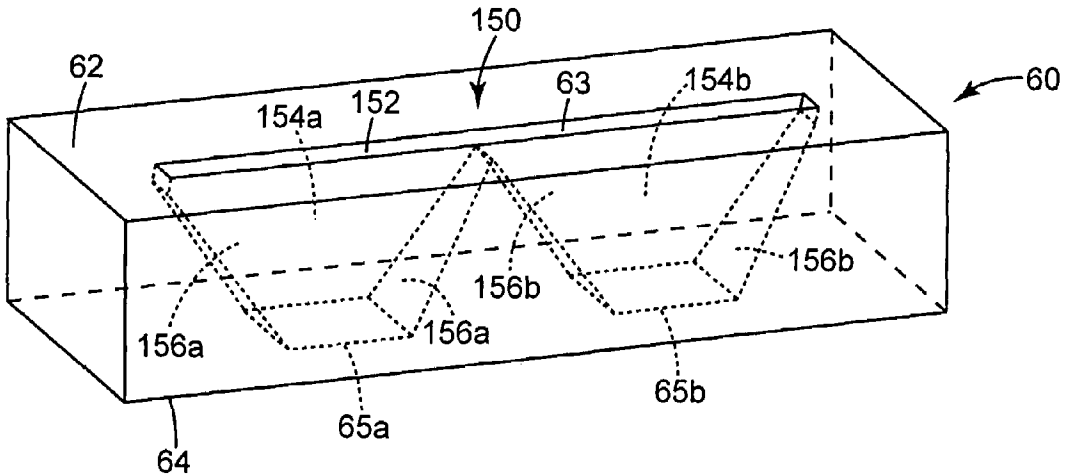

FIGS. 9A and 9B illustrate another embodiment of opening 50 through substrate 60. Opening 150, similar to openings 50 and 50', communicates with first side 62 and second side 64 of substrate 60 and provides a channel or passage through substrate 60. In addition, similar to openings 50 and 50', opening 150 includes a first portion 152 formed in and communicating with first side 62 of substrate 60. As such, similar to first portion 52, first portion 152 forms hole 63 in first side 62.

Opening 150, however, includes a plurality of second portions 154*a*, 154*b* formed in and communicating with second side 64 of substrate 60. As such, second portions 154*a*, 154*b* form respective holes 65*a*, 65*b* in second side 64. Accordingly, opening 150 also includes a plurality of third portions 156*a*, 156*b* formed in substrate 60 and extending between first portion 152 and respective second portions 154*a*, 154*b* of opening 150. More specifically, third portions 156*a*, 156*b* each have a side communicating with first portion 152, a side communicating with respective second portions 154*a*, 154*b*, and a side extending from second side 64 toward first side 62 to first portion 152. Thus, first portion 152, second portions 154*a*, 154*b*, and third portions 156*a*, 156*b* combine to form opening 150 through substrate 60.

Preferably, second portions 154*a* and 154*b* are spaced along second side 64. In one embodiment, second portions 154*a* and 154*b* are spaced such that adjacent third portions 156*a* and 156*b* extending between first portion 152 and respective adjacent second portions 154*a* and 154*b* communicate. More specifically, third portion 156*a* extending between first portion 152 and second portion 154*a* communicates with third portion 156*b* extending between first portion 152 and second portion 154*b*. As such, adjacent second portions 154*a*, 154*b* communicate via respective third portions 156*a*, 156*b* and holes 65*a* and 65*b* in second side 64 each communicate with hole 63 in first side 62. More specifically, hole 65*a* communicates with hole 63 via second portion 154*a*, third portion 156*a*, and first portion 152, and hole 65*b* communicates with hole 63 via second portion 154*b*, third portion 156*b*, and first portion 152. As third portions 156*a*, 156*b* are formed by overetching respective second portions 154*a*, 154*b*, adjacent second portions 154*a*, 154*b* directly communicate.

Figure 10A:
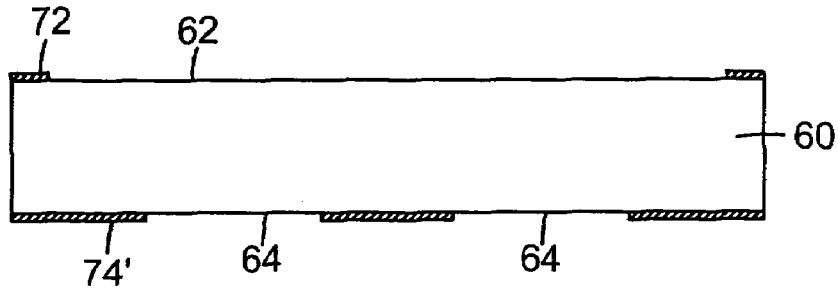
FIGS. 10A-10F are schematic cross-sectional side views illustrating another embodiment of forming an opening through a substrate according to the present invention.

FIGS. 10A-10F illustrate one embodiment of forming opening 150 through substrate 60. While only one opening 150 is illustrated as being formed, it is understood that multiple openings 150 may be formed through substrate 60. As illustrated in the embodiment of FIG. 10A, masking layers 72 and 74' are formed on substrate 60. Masking layers 72 and 74' are used to selectively control or block etching of first side 62 and second side 64, respectively, of substrate 60. Masking layers 72 and 74' are formed and patterned, as described above, with the exception that masking layer 74' is patterned to define a plurality of exposed portions of second side 64 of substrate 60.

Figure 10B:
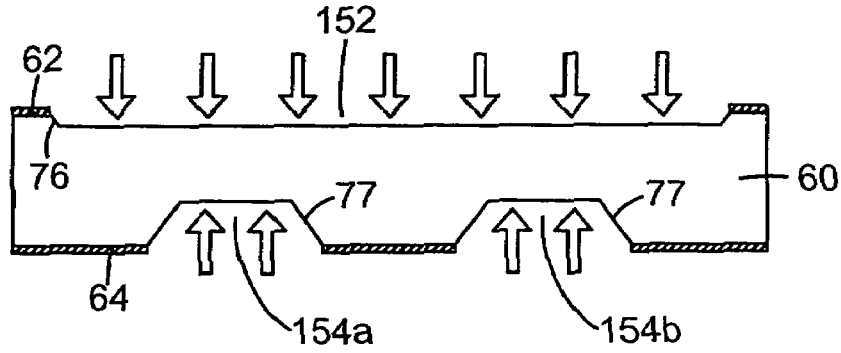

Next, as illustrated in the embodiment of FIG. 10B, first portion 152 of opening 150 is formed by etching substrate 60 from first side 62 toward second side 64 and second portions 154*a*, 154*b* are formed by etching substrate 60 from second side 64 toward first side 62. Preferably, first portion 152 and second portions 154*a*, 154*b* are formed using anisotropic wet etch processes, as described above. As such, first portion 152 of opening 150 follows crystalline plane 76 of substrate 60 and second portions 154*a*, 154*b* of opening 150 follow crystalline planes 77 of substrate 60. In one embodiment, crystalline plane 76 and crystalline planes 77 include <111> Si planes of substrate 60, as described above.

Figure 10C:
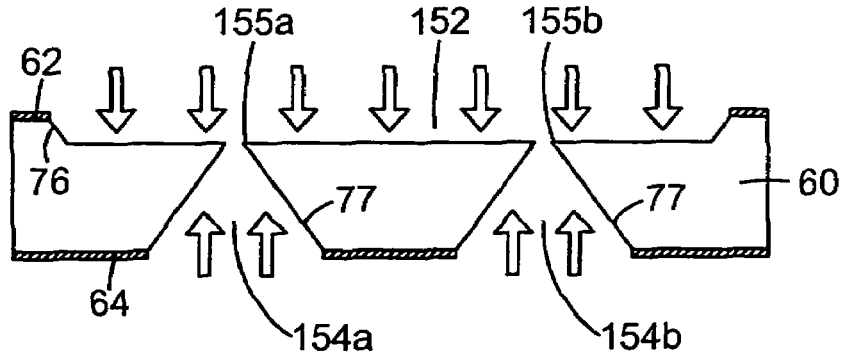

As illustrated in the embodiment of FIG. 10C, etching into substrate 60 from first side 62 toward second side 64 and/or from second side 64 toward first side 62 continues such that first portion 152 of opening 150 and second portions 154*a*, 154*b* of opening 150 connect or communicate. As such, interfaces 155*a*, 155*b* are formed between first portion 152 and respective second portions 154*a*, 154*b*.

Figure 10D:
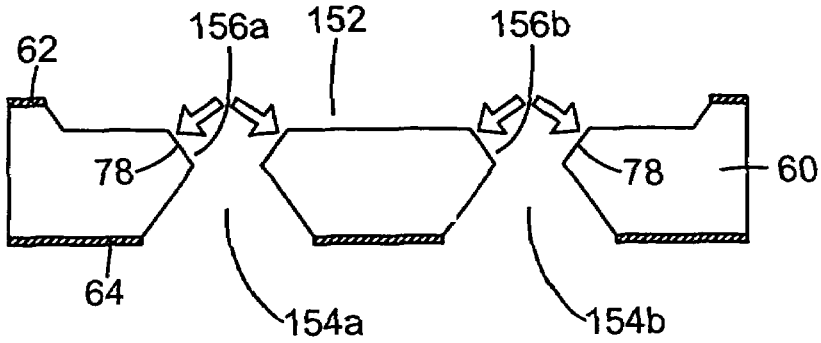

Next, as illustrated in the embodiment of FIG. 10D, third portions 156*a*, 156*b* of opening 150 are formed by etching substrate 60 from respective interfaces 155*a*, 155*b* between first portion 152 and respective second portions 154*a*, 154*b* toward first side 62 of substrate 60 and toward second side 64 of substrate 60. Preferably, third portions 156*a*, 156*b* of opening 150 are formed using an anisotropic etch process, as described above. As such, third portions 156*a*, 156*b* of opening 150 follow crystalline planes 78 of substrate 60. In one embodiment, crystalline planes 78 include low-index planes such as <111> Si planes of substrate 60. In another embodiment, crystalline planes 78 include high-index planes such as <310> Si planes of substrate 60.

Figure 10E:
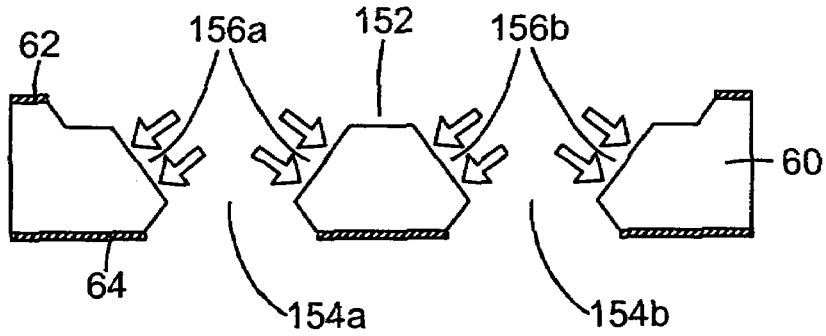

As illustrated in the embodiment of FIG. 10E, etching into substrate 60 from interfaces 155*a*, 155*b* toward first side 62 continues at an angle to first side 62 and etching into substrate 60 from interfaces 155*a*, 155*b* toward second side 64 continues at an angle to second side 64 of substrate 60. As such, first portion 152 and second portions 154*a*, 154*b* of opening 150 are overetched, as described above.

Figure 10F:
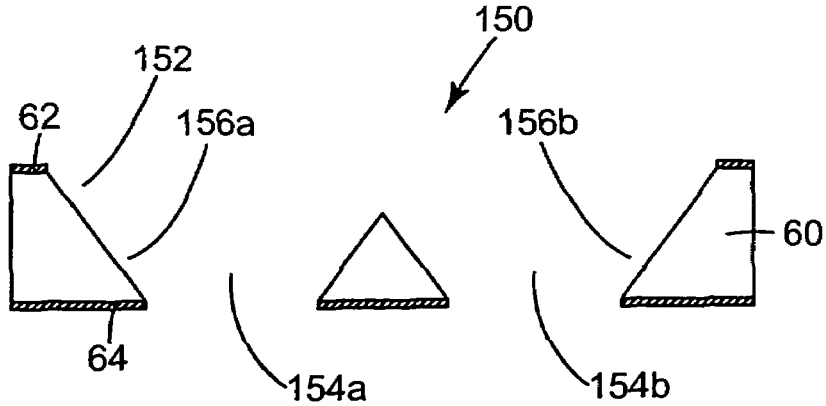

As illustrated in the embodiment of FIG. 10F, etching into substrate 60 from interfaces 155*a*, 155*b* toward first side 62 and second side 64 continues such that third portions 156*a*, 156*b* of opening 150 communicate second side 64 of substrate 60 with first portion 152 of opening 150 and, therefore, first side 62 of substrate 60. In one embodiment, etching of third portions 156*a*, 156*b* continues such that third portions 156*a* and 156*b* communicate, as described above. As third portions 156*a*, 156*b* are formed by overetching respective second portions 154*a*, 154*b*, adjacent second portions 154*a*, 154*b* directly communicate. Preferably, etching of third portions 156*a*, 156*b* of opening 50 at an angle from interfaces 155*a*, 155*b* toward first side 62 and second side 64 minimizes lateral or horizontal areas of opening 150 through substrate 60 from second side 64 to first side 62.

Figure 11B:
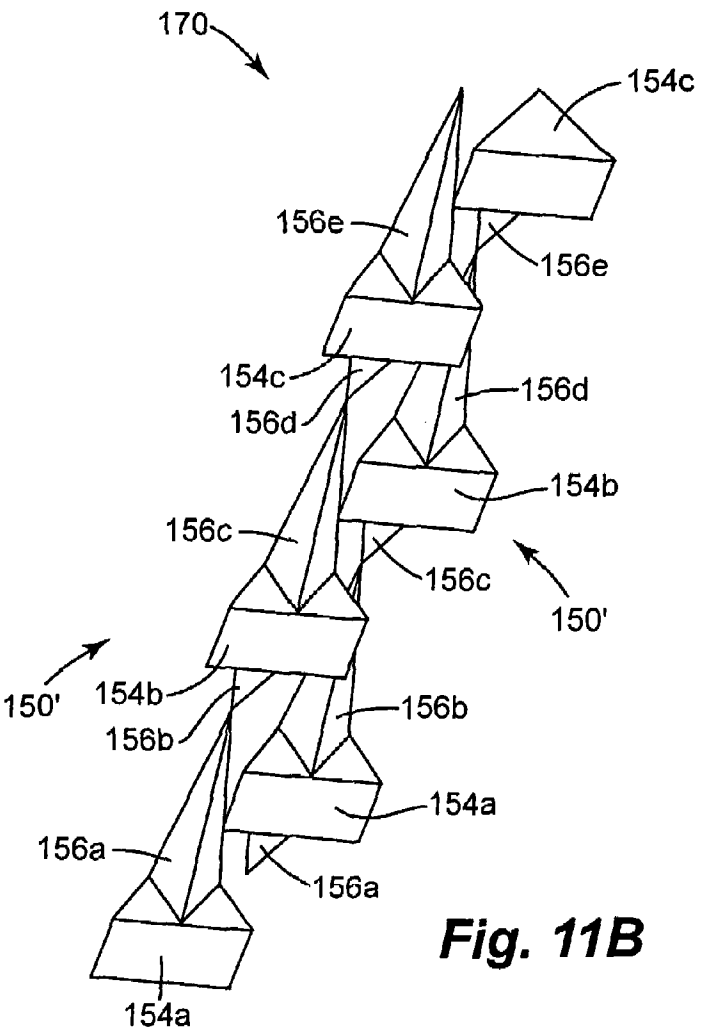
FIG. 11B is a bottom perspective view of the casting of FIG. 11A.
Figure 11A:
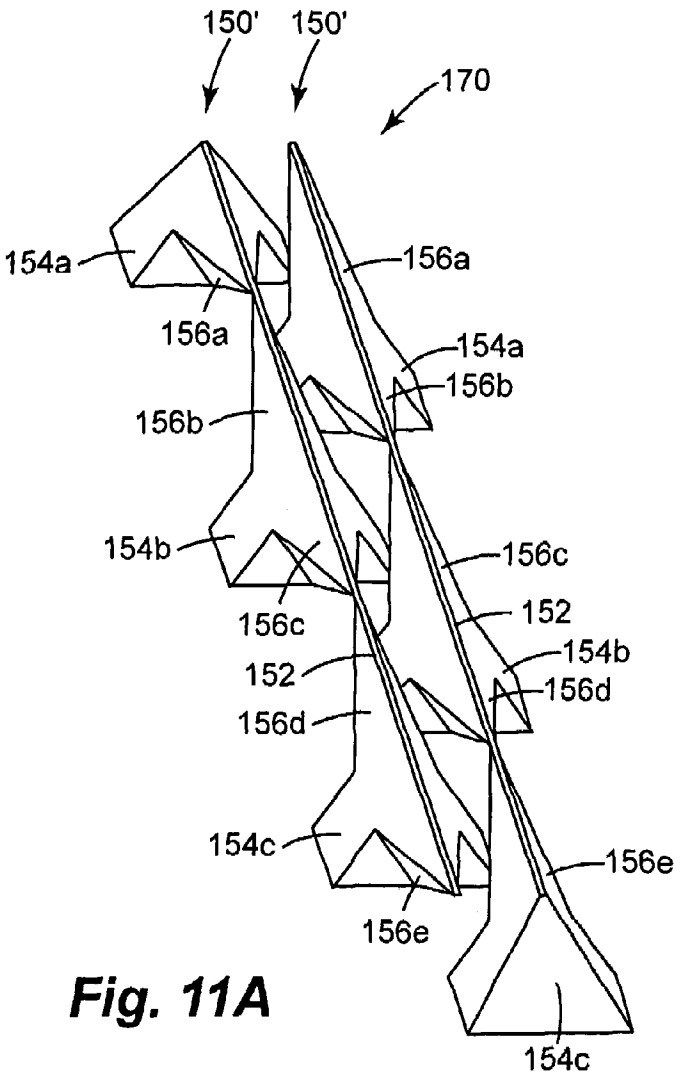
FIG. 11A is a top perspective view illustrating one embodiment of a casting of a pair of openings through a substrate according to the present invention.

FIGS. 11A and 11B illustrate one embodiment of a casting 170 of a pair of openings 150' formed through substrate 60, according to the present invention. Each opening 150' includes first portion 152, a plurality of second portions 154*a*, 154*b*, 154*c*, and a plurality of third portions 156*a*, 156*b*, 156*c*, 156*d*, 156*e* formed in manners similar to those described above. More specifically, third portions 156*a*, 156*b*, 156*c*, 156*d*, 156*e* are formed by etching along high-index planes of substrate 60, as described above. As such, first portion 152, second portions 154*a*, 154*b*, 154*c*, and third portions 156*a*, 156*b*, 156*c*, 156*d*, 156*e* communicate to form openings 150' through substrate 60. As such, each of the combined openings 150' created by first portion 152, second portions 154*a*, 154*b*, 154*c*, and third portions 156*a*, 156*b*, 156*c*, 156*d*, 156*e* are illustrated in solid form by casting 170.

Figure 13:
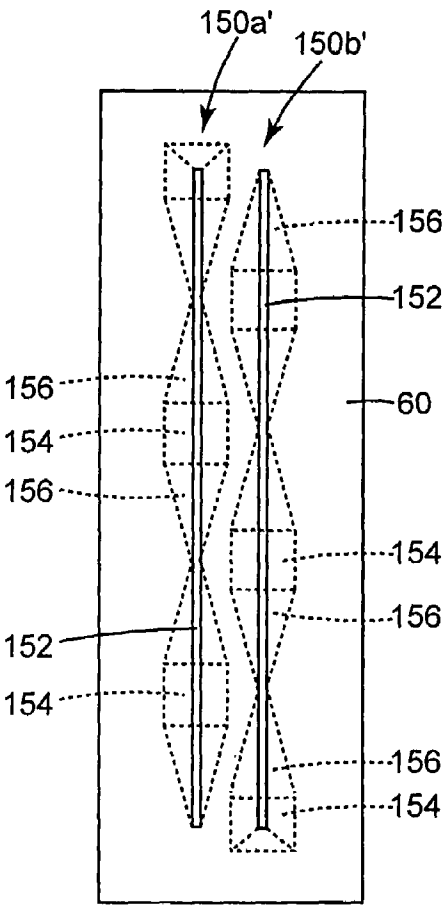
FIG. 13 is a top view illustrating another embodiment of a substrate including a pair of openings therethrough according to the present invention.
Figure 12:
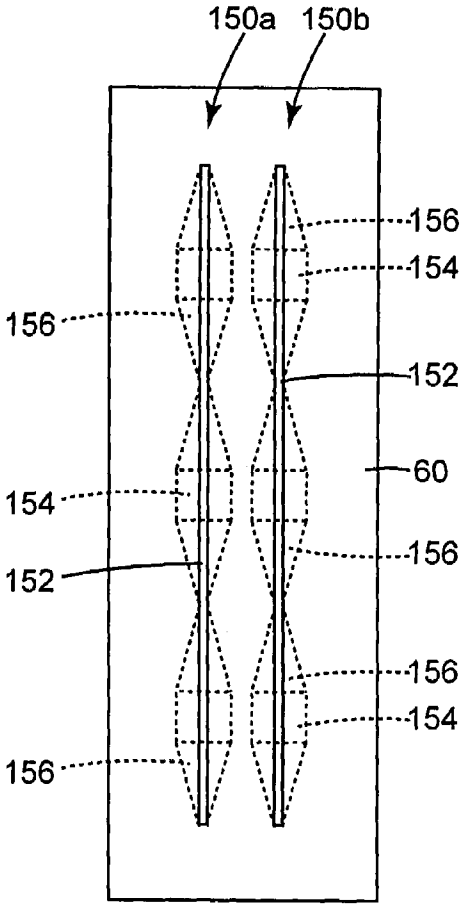
FIG. 12 is a top view illustrating another embodiment of a substrate including a pair of openings therethrough according to the present invention.

FIGS. 12 and 13 each illustrate a pair of openings formed through substrate 60 according to the present invention. As illustrated in the embodiment of FIG. 12 openings 150*a* and 150*b* each include first portion 152 formed from first side 62 of substrate 60, a plurality of second portions 154 formed from second side 64 of substrate 60, and a plurality of third portions 156 formed between respective second portions 154 and first portion 152, as described above. As such, first portion 152 of each opening 150*a* and 150*b* forms a single elongated slot in first side 62 of substrate 60 and second portions 154 of each opening 150*a* and 150*b* form a plurality of spaced slots in second side 64 of substrate 60. Thus, by forming openings 150*a* and 150*b* with spaced slots in second side 64, a single elongated trench in second side 64 of substrate 60 is avoided. Accordingly, strength of substrate 60 is enhanced and workable or useful area of second side 64 is increased.

As illustrated in the embodiment of FIG. 13, openings 150*a'* and 150*b'* each include first portion 152 formed from first side 62 of substrate 60, a plurality of second portions 154 formed from second side 64 of substrate 60, and a plurality of third portions 156 formed between respective second portions 154 and first portion 152, as described above. By forming openings 150*a'* and 150*b'* with spaced slots in second side 64, openings 150*a'* and 150*b'* can be staggered and/or offset. As such, spacing between adjacent openings 150*a'* and 150*b'* can be reduced while maintaining substrate design restraints such as strength and backside support and/or adhesion area between openings 150*a'* and 150*b'*.

As illustrated in the embodiments of FIGS. 12 and 13, first portion 152 of openings 150*a* and 150*a'* forms a first slot in first side 62 of substrate 60 and first portion 152 of openings 150*b* and 150*b'* forms a second slot in first side 62 of substrate 60 such that the first slot and the second slot are spaced from each other and form a pair of first side slots in substrate 60. In addition, second portions 154 of openings 150*a* and 150*a'* form a first plurality of slots in second side 64 of substrate 60 and second portions 154 of openings 150*b* and 150*b'* form a second plurality of slots in second side 64 of substrate 60 such that the first plurality of slots are aligned with the first slot in first side 62 of substrate 60 and the second plurality of slots are aligned with the second slot in first side 62 of substrate 60. Thus, the first plurality of slots in second side 64 form a first plurality of second side slots in substrate 60 and the second plurality of slots in second side 64 form a second plurality of second side slots in substrate 60.

In one embodiment, as illustrated in FIG. 12, the first plurality of slots in second side 64 and the second plurality of slots in second side 64 are substantially aligned with each other. In another embodiment, as illustrated in FIG. 13, the first plurality of slots in second side 64 and the second plurality of slots in second side 64 are staggered or offset with each other. As such, spacing between openings 150*a*' and 150*b*' including, more specifically, spacing between first portions 152 of openings 150*b* and 150*b*' can be reduced, as described above. In one embodiment, as illustrated in FIGS. 11A and 11B, with the first plurality of slots in second side 64 and the second plurality of slots in second side 64 being staggered or offset with each other, spacing between openings 150*a*' and 150*b*' is reduced such that the first plurality of slots in second side 64 and the second plurality of slots in second side 64 overlap. More specifically, by interleaving or overlapping the first plurality of slots in second side 64 with the second plurality of slots in second side 64, spacing between first portions 152 of openings 150*b* and 150*b*' can be further reduced.

While the above description refers to the inclusion of substrate 60 having opening 50 (including openings 50', 150, 150') formed therein in an inkjet printhead assembly, it is understood that substrate 60 having opening 50 formed therein may be incorporated into other fluid ejection systems including non-printing applications or systems as well as other applications having fluidic channels through a substrate, such as medical devices. Accordingly, the present invention is not limited to printheads, but is applicable to any slotted substrates.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A substrate for a fluid ejection device, the substrate comprising:

a first side;

a second side opposite the first side; and a fluidic channel communicating with the first side and the second side, wherein a first portion of the fluidic channel extends from the first side toward the second side, a second portion of the fluidic channel extends from the second side toward the first side, and a third portion of the fluidic channel extends from an interface between the first portion and the second portion of the fluidic channel toward the second side, wherein, in a first direction, a dimension of the first portion of the fluidic channel at the first side is greater than a dimension of the second portion of the fluidic channel at the second side, and, in a second direction substantially perpendicular to the first direction, a dimension of the second portion of the fluidic channel at the second side is greater than a dimension of the first portion of the fluidic channel at the first side.

2. The substrate of claim 1, wherein the third portion of the fluidic channel extends from the interface between the first portion and the second portion of the fluidic channel toward the first side.

3. The substrate of claim 1, wherein the third portion of the fluidic channel extends between the second portion of the fluidic channel at the second side and the first portion of the fluidic channel.

4. The substrate of claim 1, wherein the third portion of the fluidic channel extends from at least one side of the second portion of the fluidic channel.

5. The substrate of claim 4, wherein the third portion of the fluidic channel extends from two opposing sides of the second portion of the fluidic channel.

6. The substrate of claim 1, wherein the third portion of the fluidic channel includes a compound surface extending between the first portion and the second portion of the fluidic channel.

7. The substrate of claim 1, wherein the first portion of the fluidic channel has a substantially triangular-shaped cross-section, wherein the second portion of the fluidic channel has a substantially triangular-shaped cross-section, and wherein the third portion of the fluidic channel has a substantially diamond-shaped cross-section.

8. The substrate of claim 7, wherein the substantially diamond-shaped cross-section of the third portion of the fluidic channel diminishes in size from the second portion of the fluidic channel toward an end of the first portion of the fluidic channel.

9. The substrate of claim 1, wherein the first portion of the fluidic channel converges from the first side toward the second side, wherein the second portion of the fluidic channel converges from the second side toward the first side, and wherein the third portion of the fluidic channel diverges from the second side toward the first side.

10. The substrate of claim 1, wherein, in the first direction, the third portion of the fluidic channel diverges from the second side toward the first side and, in the second direction, the third portion of the fluidic channel converges from the second side toward the first side.

11. The substrate of claim 1, wherein the first portion of the fluidic channel is etched into the first side toward the second side, the second portion of the fluidic channel is etched into the second side toward the first side, and the third portion of the fluidic channel is etched from the interface between the first portion and the second portion of the fluidic channel toward the second side.

12. The substrate of claim 11, wherein the third portion of the fluidic channel is etched at an angle which is non-parallel and non-orthogonal to the second side.

13. The substrate of claim 11, wherein the first portion of the fluidic channel is anisotropically wet etched into the first side toward the second side.

14. The substrate of claim 11, wherein the second portion of the fluidic channel is anisotropically wet etched into the second side toward the first side.

15. The substrate of claim 11, wherein the third portion of the fluidic channel is anisotropically wet etched from the interface between the first portion and the second portion of the fluidic channel toward the second side.

16. The substrate of claim 1, wherein the substrate is a silicon substrate, wherein the first portion of the fluidic channel is formed along a first crystalline plane of the silicon substrate, the second portion of the fluidic channel is formed along a second crystalline plane of the silicon substrate, and the third portion of the fluidic channel is formed along a third crystalline plane of the silicon substrate.

17. The substrate of claim 16, wherein the first crystalline plane, the second crystalline plane, and the third crystalline plane of the silicon substrate are each a low-index plane of the silicon substrate.

18. The substrate of claim 17, wherein the low-index plane of the silicon substrate includes a binary plane of the silicon substrate.

19. The substrate of claim 16, wherein the first crystalline plane and the second crystalline plane of the silicon substrate are each a low-index plane of the silicon substrate and the third crystalline plane of the silicon substrate is a high-index plane of the silicon substrate.

20. The substrate of claim 19, wherein the low-index plane of the silicon substrate includes a binary plane of the silicon substrate and the high-index plane of the silicon substrate includes a non-binary plane of the silicon substrate.

21. A substrate for a fluid ejection device, the substrate comprising:

a first side;

a second side opposite the first side; and a fluidic channel communicating with the first side and the second side, wherein a first portion of the fluidic channel converges from the first side toward the second side, a second portion of the fluidic channel converges from the second side toward the first side, and a third portion of the fluidic channel diverges from the second side toward the first side, wherein, in a first direction, the first portion of the fluidic channel at the first side is longer than the second portion of the fluidic channel at the second side, and, in a second direction substantially perpendicular to the first direction, the second portion of the fluidic channel at the second side is wider than the first portion of the fluidic channel at the first side.

22. The substrate of claim 21, wherein the third portion of the fluidic channel diverges from the second side toward the first side in the first direction and converges from the second side toward the first side in the second direction.

23. The substrate of claim 21, wherein the first portion of the fluidic channel has one of a substantially triangular-shaped cross-section and a substantially trapezoidal-shaped cross-section, wherein the second portion of the fluidic channel has one of a substantially triangular-shaped cross-section and a substantially trapezoidal-shaped cross-section, and wherein the third portion of the fluidic channel has one of a substantially diamond-shaped cross-section and a substantially trapezoidal-shaped cross-section.

24. The substrate of claim 23, wherein the one of the substantially diamond-shaped cross-section and the substantially trapezoidal-shaped cross-section of the third portion of the fluidic channel diminishes in size from the second portion of the fluidic channel toward an end of the first portion of the fluidic channel.

25. The substrate of claim 21, wherein the first portion of the fluidic channel has a substantially triangular-shaped cross-section, wherein the second portion of the fluidic channel has a substantially triangular-shaped cross-section, and wherein the third portion of the fluidic channel has a substantially diamond-shaped cross-section.

26. The substrate of claim 25, wherein the substantially diamond-shaped cross-section of the third portion of the fluidic channel diminishes in size from the second portion of the fluidic channel toward an end of the first portion of the fluidic channel.

27. The substrate of claim 21, wherein the first portion of the fluidic channel has a substantially triangular-shaped cross-section, wherein the second portion of the fluidic channel has a substantially triangular-shaped cross-section, and wherein the third portion of the fluidic channel has a substantially trapezoidal-shaped cross-section.

28. The substrate of claim 27, wherein the substantially trapezoidal-shaped cross-section of the third portion of the fluidic channel diminishes in size from the second portion of the fluidic channel toward an end of the first portion of the fluidic channel.

29. The substrate of claim 21, wherein the first portion of the fluidic channel has a substantially trapezoidal-shaped cross-section, wherein the second portion of the fluidic channel has a substantially trapezoidal-shaped cross-section, and wherein the third portion of the fluidic channel has a substantially diamond-shaped cross-section.

30. The substrate of claim 29, wherein the substantially diamond-shaped cross-section of the third portion of the fluidic channel diminishes in size from the second portion of the fluidic channel toward an end of the first portion of the fluidic channel.

31. The substrate of claim 21, wherein the first portion of the fluidic channel has a substantially trapezoidal-shaped cross-section, wherein the second portion of the fluidic channel has a substantially trapezoidal-shaped cross-section, and wherein the third portion of the fluidic channel has a substantially trapezoidal-shaped cross-section.

32. The substrate of claim 31, wherein the substantially trapezoidal-shaped cross-section of the third portion of the fluidic channel diminishes in size from the second portion of the fluidic channel toward an end of the first portion of the fluidic channel.

* * * * *